US005571295A

United States Patent [19]

Kowoll

[11] Patent Number: 5,571,295

[45] Date of Patent: Nov. 5, 1996

[54] PROCESS FOR COOLING OF A PARTIAL OXIDATION CRUDE GAS

[75] Inventor: Johannes Kowoll, Bochum, Germany

[73] Assignee: Krupp Koppers GmbH, Essen, Germany

[21] Appl. No.: 343,105

[22] Filed: Nov. 22, 1994

[30] Foreign Application Priority Data

Nov. 25, 1993 [DE] Germany ..... 43 40 156.2

[51] Int. Cl.[6] ..... C10J 3/06; C10J 3/08; C10J 3/16

[52] U.S. Cl. ..... 48/197 R; 48/203; 48/206; 95/228

[58] Field of Search ..... 48/197 R, 203, 48/206, 210, DIG. 2; 261/117, 118; 55/149, 205, 219, 220, 230, 228; 252/373

[56] References Cited

U.S. PATENT DOCUMENTS

| | | | |
|---|---|---|---|
| 2,971,830 | 2/1961 | Kawai et al. | 48/206 |
| 4,013,427 | 3/1977 | Gernhardt et al. | 48/DIG. 2 |
| 4,054,424 | 10/1977 | Staudinger et al. | 48/DIG. 2 |
| 4,279,622 | 7/1981 | Jones et al. | 48/206 |
| 4,494,963 | 1/1985 | Reich | 48/DIG. 2 |
| 4,581,899 | 4/1986 | von Klock et al. | 48/197 R |
| 4,671,806 | 6/1987 | Stil et al. | 48/DIG. 2 |
| 4,874,037 | 10/1989 | Papst et al. | 48/DIG. 2 |
| 4,936,871 | 6/1990 | Wilmer et al. | 48/206 |
| 4,936,873 | 6/1990 | Richard | 48/210 |
| 4,954,136 | 9/1990 | Jokisch et al. | 48/DIG. 2 |

FOREIGN PATENT DOCUMENTS

| | | | |
|---|---|---|---|
| 2710154 | 9/1928 | Germany | 48/206 |

*Primary Examiner*—Peter Kratz
*Attorney, Agent, or Firm*—Michael J. Striker

[57] ABSTRACT

The process for cooling of partial oxidation crude gas includes partially oxidizing a fine grained to powdery combustible material in a flow gasifier in the presence of water vapor and an oxidizing member selected from the group consisting of oxygen and air at pressures of up to 100 bar and at temperatures above a cinder melting point to form a crude gas flow; feeding the crude gas flow in a crude gas duct in an upward crude gas flow direction; and feeding an annular cooling flow of a gaseous or vaporous cooling fluid into the crude gas flow in a downward direction opposite to the crude gas flow direction, the annular cooling flow being bounded by interior walls of the crude gas duct. In a preferred embodiment the annular cooling flow is fed into an upper quenching chamber having a diameter smaller than a downstream connected lower quenching chamber through which the crude gas flows so as to prevent upward extension of any growing cinder layer.

4 Claims, 1 Drawing Sheet

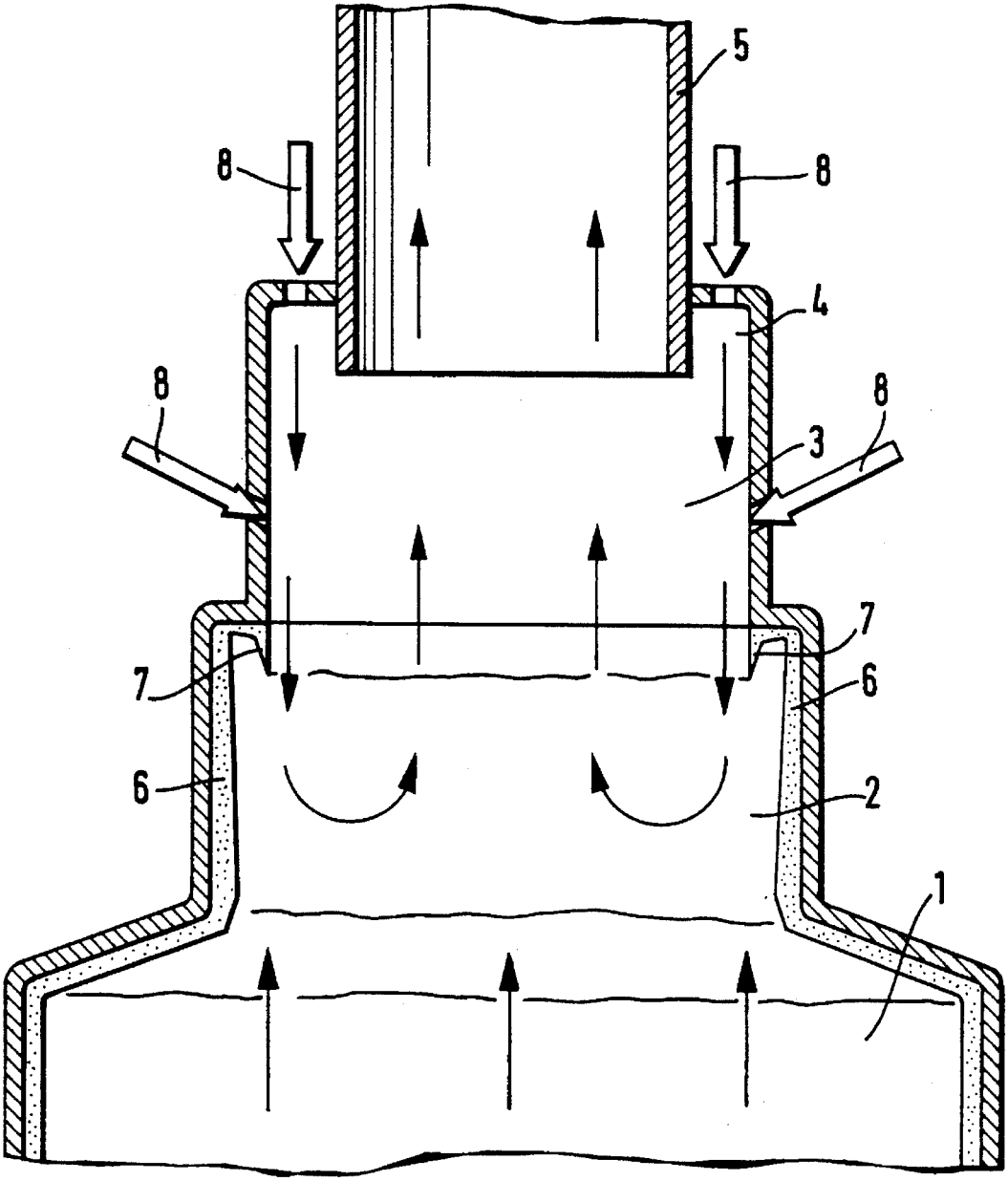
5
8
8
4
8
8
3
7
7
6
6
2
1

PROCESS FOR COOLING OF A PARTIAL OXIDATION CRUDE GAS

BACKGROUND OF THE INVENTION

The present invention relates to a process and apparatus for cooling of partial oxidation crude gas.

A process for cooling of partial oxidation crude gas is known comprising gasifying, i.e. partially oxidizing, a fine grained to powdery combustible material in a flue flow gasifier in the presence of oxygen and/or air and water vapor at pressures of up to 100 bar and temperatures above the cinder melting point to form a crude gas and quenching the crude gas with a gaseous and/or vaporous cooling fluid.

The gasification temperature is from about 1500° C. to about 2000° C. in the gasifying of fine grained to powdery combustible material under the above-described conditions. During the flow of the partial oxidation crude gas flow through the so-called crude gas duct, it is cooled by chemical reactions and by heat transfer to the cooled walls of the crude gas duct. The term "crude gas duct" usually means that section comprising the reactor shaft of the gasification reactor above the burner plane and the pipe section immediately following it which is usually a radiative cooling means. Downstream of the crude gas duct the temperatures of the partial oxidation crude gas are between about 800° and 1600° C. according to the structural height and cooling of the crude gas duct. For additional cooling the gas in the crude gas duct is conducted into a convection cooler or a combination radiation-convection heat exchanger unit. The partial oxidation crude gas produced in the gasifier contains however components, which are deposited from the crude gas flow because of the decreasing gas temperature and which can form deposits both on the walls of the crude gas duct and also in a downstream cooling device. The deposits consist of adhering and/or melted ash and/or cinders. The gas flow and the heat transfer from it are reduced, or even completely stopped or prevented, because of these deposits, which are only removed with great difficulty by currently available means. It is therefore necessary to cool the crude gas downstream of the gasification reactor to such an extent that no deposits form on the walls immediately downstream of the gasification reactor. For this purpose it is already known to mix the hot crude gas stream in the vicinity of the crude gas duct upper of the gasification reactor with a a gaseous or vaporous cooling fluid at a comparatively lower temperature. The method, which is known to one skilled in the art as quenching, can be performed with a cooled product gas feedback, with water vapor and with any other gas which does not adversely effect the desired gas composition. For this purpose various methods have already been suggested in which an input of cooling fluid is provided in a partial flow through a circular gap or a number of entrance openings in the jacket of the crude gas duct, whereby the quenching gas feed occurs either horizontally into or synchronously with the upwardly flowing crude gas. It has been proven that the formation of deposits cannot be avoided under unfavorable conditions. Under unfavorable conditions the deposits can grow until near the quenching region of the crude gas duct and partially block the admission of quenching gas in the crude gas duct, so that the operation of the quenching process is considerably disturbed. Individual cinder pieces can be loosened during sudden pressure fluctuations and then reach the quenching gas guide duct and lodge there. This danger is particularly present with a horizontal quenching gas feed. These deposits are removed only with great difficulty with the standard mechanical cleaning devices because of the plastic surfaces which these deposits have on their hot side facing the crude gas stream.

Another method, in which a portion of the cooling fluid is conducted radially through the jacket of the crude gas duct into the crude gas stream, while the other portion of the cooling fluid is fed by an axial quenching pipe located in the crude gas duct in an opposite direction to the crude gas flow, is described in German Published Patent Application DE OS 38 08 729. This process always presupposes the presence of a suitably arranged quenching pipe. This sort of disadvantage however presents problems from the standpoint of flow engineering.

SUMMARY OF THE INVENTION

It is an object of the present invention to provide a process of the above-described type in which operational difficulties caused by formation of deposits are avoided as much as possible.

It is another object of the invention to provide an apparatus of the above-described type required for performing the process which is as simple as possible and which has no troublesome built-in structures in the crude gas duct.

These objects and others which will be made more apparent hereinafter are attained in a process for cooling of partial oxidation crude gas comprising the steps of partially oxidizing a fine grained to powdery combustible material in a flue flow gasifier in the presence of water vapor and oxygen or air at pressures of up to 100 bar and temperatures above a cinder melting point to form a crude gas and quenching the crude gas formed in the partial oxidizing with a gaseous and/or vaporous cooling fluid.

According to the invention the crude gas is fed through a crude gas duct in an upward crude gas flow direction and an annular cooling flow of a gaseous or vaporous cooling fluid is fed into the crude gas flow in a downward direction opposite to the crude gas flow direction. This annular cooling flow is bounded by interior walls of the crude gas duct.

In preferred embodiments the flow of cooling fluid in the ring-shaped region in the crude gas duct is spun, i.e. provided with a circumferential velocity component. It is also desirable to periodically interrupt the inflow of cooling fluid for a short time interval and at the same time to feed the cooling fluid into the crude gas flow in a direction inclined to the vertical.

The apparatus for cooling the crude gas according to the invention includes a crude gas duct above the gasifier comprising a lower quenching chamber and an upper quenching chamber connected to the lower quenching chamber and above it. The lower quenching chamber is preferably directly connected to and above the reactor shaft. The upper quenching chamber is provided with a ring duct in the vicinity of its interior walls and should be from 10 to 100 cm smaller in diameter than the diameter of the lower quenching chamber. The cooling fluid is fed in a preferred embodiment in a downward direction opposite to the crude gas flow into the upper quenching chamber through the ring duct.

BRIEF DESCRIPTION OF THE DRAWING

The objects, features and advantages of the present invention will now be illustrated in more detail by the following detailed description, reference being made to the accompanying drawing in which:

The sole FIGURE is a cross-sectional view through an apparatus for performing the process according to the invention.

DESCRIPTION OF THE PREFERRED EMBODIMENTS

In the apparatus shown in the drawing the crude gas duct comprises a reactor shaft 1 located above the burner plane of the gasification reactor, to which the lower quenching chamber 2 immediately above the gasification reactor is connected. The lower quenching chamber 2 continues or is connected to the upper quenching chamber 3, whose diameter is however smaller than the diameter of the lower quenching chamber 2. The quenching gas acting as cooling fluid is fed through a ring duct or opening 4 in the upper quenching chamber 3 near the interior wall of the upper quenching chamber 3. A pipe section 5 forming a part of the radiative cooling means is connected to the upper quenching chamber 3. In the preferred embodiment shown in the drawing the ring duct 4 surrounds and is near the lower outer wall of the pipe section 5. An unshown convective cooler and/or cooler-heat exchanger is connected by the pipe section 5 with the crude gas duct.

In operation of the apparatus according to the invention the quenching gas conducted through the ring duct 4 first flows vertically downward into the upper quenching chamber 3 in the vicinity of the inner walls of that quenching chamber and arrives in this way in the lower quenching chamber 2, whose diameter is larger than the diameter of the upper quenching chamber 3. The size of the increase of the diameter in the lower quenching chamber 2 is chosen so that the downward flow of quenching gas is reversed by the upwardly flowing partial oxidation crude gas stream and thus entry of the quenching gas into the reactor shaft 1 is avoided. The quenching gas arrives together with the partial oxidation crude gas flowing upward and issuing from the reactor shaft 1 in the pipe section 5, in which both gases are mixed together and simultaneously additionally cooled. The flow direction of the gas is indicated in the FIGURE by the solid arrows. Another consideration determining the difference of the diameters of the upper and lower quenching chambers is the fact that these differences in each case must be larger than the thickness of the cinder deposit layer 6, which is deposited in the lower region of the crude gas duct. In practice based on the above described considerations the diameter of the upper quenching chamber 3 is calculated to be between 10 and 100 cm smaller than the diameter of the lower quenching chamber 2.

The growth of the cinder deposit layer 6 from the lower quenching chamber 2 into the upper quenching chamber 3 is prevented by feeding the quenching gas into the upper quenching chamber. The cinder deposit layer 6 can of course still grow parallel to the downward flow of the quenching gas and forms thus a cone-like deposit 7 at the upstream end of the upper quenching chamber 3. This growth is however interrupted at the position at which the speed of the downward flowing quenching gas is too small and its temperature is too high to prevent the melting of the cinders at the tip or end of the cone-like deposit 7. Under certain operating conditions, namely comparatively lower gasification temperature and higher cinder melting point for the fuel being used, in this case a coal fuel, the temperature is too low in the lower quenching chamber 2 to melt off the cone-like pointed deposit 7 and to prevent its growth. Under these conditions the quenching gas fed through the ring duct 4 is periodically interrupted for a short time. The temperature increase caused by that interruption in the lower quenching chamber 2 causes then a melting away of the cinder deposit. During this time interval the quenching gas feed can be either interrupted or the quenching gas is completely or partially conducted by special gas feed devices, which are not illustrated in the drawing, into the crude gas flow advantageously with a quenching gas flow direction which is inclined downwardly into the crude gas flow. This embodiment of the method is indicated by the arrows 8 in the drawing. Naturally it is also possible in the case of a quenching gas lateral feed of this type to direct the inwardly flowing quenching gas horizontally or inclined upwardly into the crude gas flow.

Under circumstances in which there is intense turbulence of the gas flow and still uncompensated temperature differences between the partial oxidation crude gas and the quenching gas increased deposits can be found at the entrance to the pipe section 5. To avoid this it is appropriate to provide the quenching gas conducted into the crude gas duct flow with a spin or twist, which means a velocity component in the circumferential direction. The required twist of the quenching gas flow can be obtained by not conducting the quenching gas flow into the lower quenching chamber directly opposite to the crude gas flow direction indicated by the solid arrows, but instead tangentially, through the ring duct 4.

Understandably in the apparatus according to the invention the cleaning of the wall surfaces can also be assisted by mechanical cleaning means, e.g. a knocking or tapping device, which can mounted on the outside wall of both quenching chambers 2 and 3 and also on the outer walls of the pipe section 5. It is also possible to provide the apparatus with an expansion joint for compensating differing thermal expansion in the upper quenching chamber 3.

The advantages of the apparatus and method according to the invention include the following:

- a growth of the cinder layer in the quenching region of the crude gas duct is prevented by the quenching;
- no surfaces are present in the apparatus according to the invention which can support a cinder layer;
- cinders cannot reach the downwardly open ring duct 4;
- the cinder layer eventually deposited on the wall of the upper quenching chamber 3 is cooled so intensively by the downwardly flow of the quenching gas near the interior of the wall upper quenching chamber 3 that a comparatively cold cinder layer is so brittle that its removal by mechanical cleaning means (clopping device) is possible without difficulty or problem;
- the mixing section required for the desired temperature balancing between the partial oxidation crude gas and the quenching gas is comparatively short because a special turbulent mixing of both gas flows occurs with the type of quenching gas feed according to the invention.

It will be understood that each of the elements described above, or two or more together, may also find a useful application in other types of constructions differing from the types described above.

While the invention has been illustrated and described as embodied in a process and apparatus for cooling of a partial oxidation crude gas, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims.

What is claimed is:

1. A process for cooling of partial oxidation crude gas comprising the steps of:

a) partially oxidizing a fine grained to powdery combustible material in a flow gasifier in the presence of water vapor and an oxidizing member selected from the group consisting of oxygen and air at pressures of up to 100 bar and at temperatures above a cinder melting point to form a crude gas flow;

b) feeding the crude gas flow in a crude gas duct in an upward crude gas flow direction; and c) feeding an annular cooling flow of a gaseous or vaporous cooling fluid into the crude gas flow in a downward direction opposite to the crude gas flow direction, said annular cooling flow being bounded by interior walls of the crude gas duct, and further comprising providing a lower substantially cylindrical quenching chamber and an upper substantially cylindrical quenching chamber, said upper quenching chamber being connected to said lower quenching chamber downstream in said crude gas flow direction from said lower quenching chamber, and wherein said feeding of said annular cooling flow into said crude gas flow is in said upper quenching chamber, wherein said upper quenching chamber has a smaller diameter than said lower quenching chamber to prevent the growth of a cinder deposit layer from the lower quenching chamber into the upper quenching chamber.

2. The process as defined in claim 1, further comprising interrupting said feeding of said annular cooling flow periodically to provide periodic interruptions of said annular cooling flow.

3. The process as defined in claim 2, further comprising feeding said cooling fluid into said crude gas flow in a direction downwardly inclined in relation to the crude gas flow direction during said periodic interruptions of said feeding of said annular cooling flow.

4. The process as defined in claim 1, further comprising providing said annular cooling flow with a flow velocity component in a circumferential direction around said crude gas duct during said feeding so that said annular cooling flow of said cooling fluid spins circumferentially.

* * * * *